United States Patent [19]

Crocker

[11] Patent Number: 4,809,866

[45] Date of Patent: Mar. 7, 1989

[54] SPILL-CONTAINMENT DEVICE

[75] Inventor: Weyman S. Crocker, Putney, Vt.

[73] Assignee: Burt Equipment Co., Inc., Westminster Station, Vt.

[21] Appl. No.: 50,775

[22] Filed: May 18, 1987

[51] Int. Cl.[4] ..... B65D 25/00

[52] U.S. Cl. ..... 220/86 R; 141/86

[58] Field of Search ..... 141/86; 285/42, 192; 220/85 F, 85 R

[56] References Cited

U.S. PATENT DOCUMENTS

| | | | |
|---|---|---|---|
| 4,086,736 | 5/1978 | Landigan | 285/192 X |
| 4,278,115 | 7/1981 | Briles et al. | 141/86 |
| 4,457,349 | 7/1984 | Vazin | 141/86 |
| 4,520,852 | 6/1985 | Klein | 141/86 |
| 4,527,708 | 7/1985 | Dundas et al. | 220/18 |
| 4,615,362 | 10/1986 | Hartman et al. | 141/86 |
| 4,655,361 | 4/1987 | Clover et al. | 141/86 X |

FOREIGN PATENT DOCUMENTS

| | | | |
|---|---|---|---|
| 339678 | 12/1930 | United Kingdom | 285/192 X |

*Primary Examiner*—Mark J. Thronson
*Attorney, Agent, or Firm*—Steward & Steward

[57] ABSTRACT

A spill-containment device for use in connection with the fill-pipe for a liquid storage tank, which includes a spill container installed around the upper end of the fill-pipe and sealed thereto so that it does not leak liquid spilled into the container when the storage tank is being filled by means of the unloading hose of a delivery truck. The upper end of the spill container is open for access to the fill-pipe and has a manhole cover. The seal between the bottom of the spill container and the fill-pipe includes an elongated flexible boot which is fastened at its upper end to the fill-pipe by means of a stainless steel hose clamp and at its lower end to an upstanding flange aligned with an opening in the bottom of the container through which the fill-pipe extends. The open end of the spill container has a novel channel-forming rim for preventing surface water from entering the spill container while at the same time holding the manhole cover in place. A hand-pump is also provided for removing the spilled liquid in the container.

5 Claims, 2 Drawing Sheets

SPILL-CONTAINMENT DEVICE

The invention relates to spill-control systems for liquid storage tanks to prevent contamination of the environment, and it relates more particularly to underground containers or manholes for containing petroleum products, such as gasoline and diesel fuel, when the product is spilled while being transferred from a transport tank, for example a delivery tank truck, to an underground storage tank at a service station.

BACKGROUND OF THE INVENTION

Contamination of the ground, water and air in the environment has become a serious problem in recent times. One source of such contamination is in the spillage of fluids, particularly petroleum products at storage facilities for such products. For instance, storage tanks at gasoline filling stations are located underground and have a fill-pipe which extends upward from the tank to ground level so that the unloading hose of a tank truck can be connected to the open end of the fill-pipe in order to fill the storage tank. Spillage of gasoline is almost unavoidable during this process and various devices for containing the gasoline thus spilled have been devised in order to prevent it from saturating the ground and seeping into underground water sources or from flowing on the surface into streams and rivers.

United States patents granted on such devices and similar systems include the following:

U.S. Pat. No. 4,278,115 Briles
U.S. Pat. No. 4,457,349 Vazin
U.S. Pat. No. 4,520,852 Klein
U.S. Pat. No. 4,527,708 Dundas et al
U.S. Pat. No. 4,615,362 Hartman et al In general, containment is achieved by installing a container or manhole below ground level around the upper end of the fill-pipe so that any gasoline spilled is trapped within the container and then removed therefrom, either back into the fill-pipe or into an external waste container. In some cases this spillage drains by gravity into the storage tank through drainage pipes in the bottom of the spill container. In others, a sump or accumulating tank is provided below the spill container. Still others have complicated systems of containing the spilled fluid and preventing it from vaporizing into the atmosphere, as well as limiting the amount of fluid that is spilled.

One of the problems with such spill containers now available is that they are frequently complicated and expensive to manufacture and install. Even in those devices which provide only a simple sump below the spill container, it is difficult and expensive for small gasoline station operators to install the container or to remove it for replacement or repair. Another serious problem encountered has been in maintaining the seal between the spill container and the fill-pipe in order to prevent the fluid trapped i the container from leaking into the ground. The difficulty is that frost will lift and/or tilt the spill container relative to the spill-pipe. Settlement of the ground will also cause such movement. In new tank installations even the tank itself may move enough to make the fill-pipe move within the spill container. Similarly, those systems which have a drainage line from the spill container back into the fill-pipe are subject to malfunctions and require substantial excavation around the fill-pipe simply to repair the piping below the container It is important therefore that spill-control devices of this type be as simple, reliable and inexpensive to manufacture as possible Several specific areas where improvements in this respect have been needed are, (1) in the seal that must be made at the point where the fill-pipe enters the container in order to prevent leakage of the spilled fuel therefrom, while permitting movement of the spill container relative to the fill-pipe due to frost and soil settling, (2) in the means by which the spilled fluid is removed from the spill container and (3) in preventing water, dirt and other debris from entering the container and contaminating spilled fluid captured within the container.

It is accordingly the object of this invention to provide a pollution control device which is inexpensive to manufacture and install, requires little or no maintenance and which is dependable not only in containing fluid spilled during transfer, but also in avoiding contamination of the spilled fluid by rain water and other foreign material.

SUMMARY OF THE INVENTION

The spill-containment device of the present invention comprises a spill container for trapping fluid spilled while a storage tank is being filled. The container has one or more side-walls (depending on whether it is rounded or rectangular in shape) that define a space of predetermined volume The container is closed at the bottom but has an opening in it for receiving the upper end of the fill-pipe to the storage tank, the upper end being open for access to the spill-pipe, so that the unloading hose of a tank truck can be connected to it. A removable cover is also provided for the open end of the container.

An important aspect of the invention resides in the specific means by which a seal is made between the outer surface of the fill-pipe and the opening in the bottom of the container through which it extends, in order to prevent leakage around the fill-pipe through the bottom of the container. To this end, a circular flange is provided in alignment with the opening in the bottom of the tank and welded or otherwise rigidly fixed to the bottom so that it does not leak. This flange may extend upward through the opening in the bottom of the container and above it, or it could be larger than the opening for the fill-pipe and welded to the upper surface of the bottom so that it surrounds the opening. A flexible boot is provided in order to prevent leakage between the spill-pipe and the flange on the bottom of the container. One end of the boot fits closely around the fill-pipe and is sealingly fastened thereto by a suitable clamp. The other end of the boot fits closely around the outer surface of the upstanding flange and is fastened thereto by a second clamp. The clamps employed for sealingly fastening the boot to the fill-pipe and flange in the bottom of the spill container, respectively, are desirably stainless steel hose clamps similar to those commonly used to make tight connections in flexible plastic pipe or automobile hoses.

In another aspect of the present invention, the open end of the container is provided with a removable cover which is supported by the upper edges of the side-wall with its upper surface substantially level with the surface of the pavement or ground level surrounding the container. A channel-forming rim is fixed to the outer surface of the side-wall around the upper edge thereof and has horizontal and vertical legs, the inner edge of the horizontal leg being fixed to the side-wall of the container below the upper edge thereof. The vertical leg extends upward from the outer edge of the horizontal leg to ground level above the upper edge of the container. Thus, the rim and side-wall of the container form a drainage channel for collecting surface water and the like, and preventing it from flowing into the container. One or more holes are provided in the horizontal leg of the rim for letting the surface water drain from the channel. In addition, the vertical leg of the rim prevents the manhole cover from shifting laterally on the upper edges of the container, while the horizontal leg of the rim is spaced below the underside of the cover.

In a further aspect of the invention, a hand pump is provided for removing the liquid spilled in the container. A coupling member is provided in the bottom of the container for removably receiving the suction end of the pump and for holding the suction end thereof at the bottom of the tank. The discharge tube of the pump can then be inserted into the open end of the storage tank fill-pipe in order to pump the spilled fluid into the tank, or it can be discharged into an external waste container above ground if for any reason the spillage is contaminated.

DESCRIPTION OF PREFERRED EMBODIMENTS

These and other aspects or features of the invention will be more apparent from the specification and claims herein after, reference being made to the accompanying drawings wherein:

Figure 1:
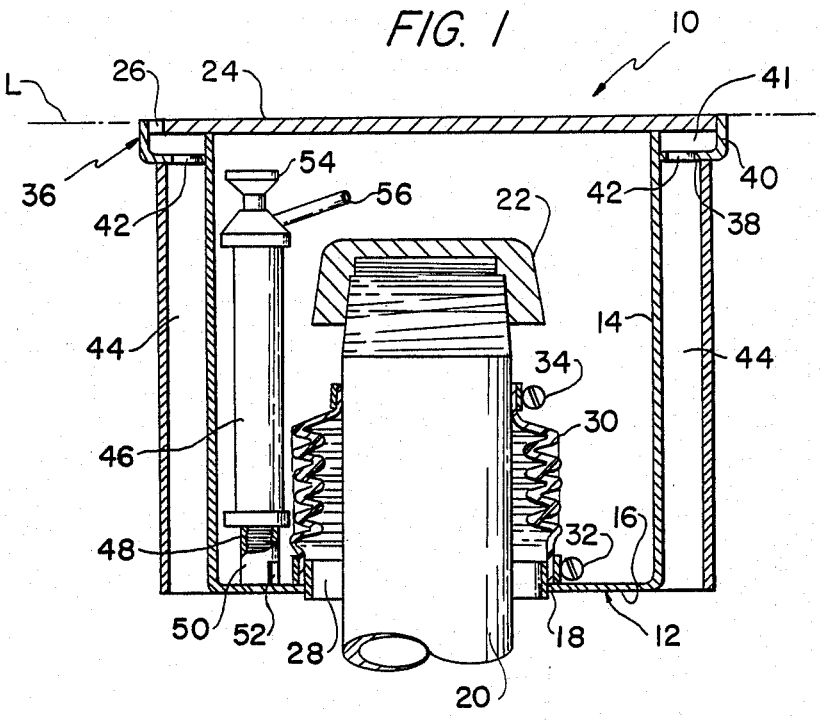
FIG. 1 is a front elevational, sectional view of a spill-container embodying the invention installed around a fill-pipe of a typical underground gasoline storage tank.
Figure 2:
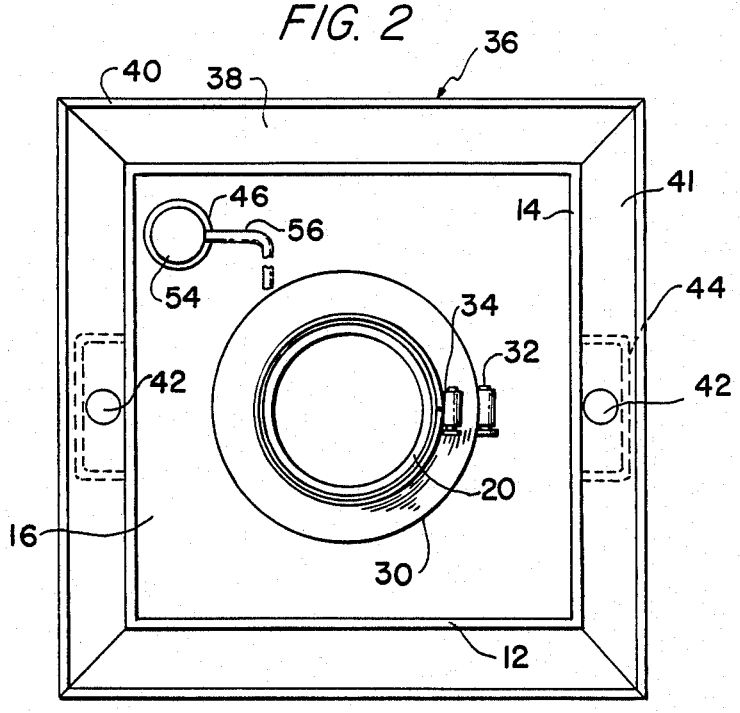
FIG. 2 is a top view of the spill container shown in FIG. 1, but with the manhole cover and fill-pipe cap removed.

The spill-control device designated generally at 10 includes a container or manhole 12, having in this instance four side-walls 14 defining a space of predetermined capacity, e.g. ten gallons. The bottom 16 of container 12 is formed integrally therewith and has a circular opening 18 which fits loosely around the upper end of a fill-pipe 20 for an underground gasoline storage tank (not shown). The upper end of container 12 is open, in order to provide access to the fill-pipe 20, which in this instance is provided with a threaded cap 22. A removable manhole cover 24 rests on the upper edges of side-walls 14 and has a cut-out 26 on one side which facilitates lifting the cover for access to fill-pipe 20. The container side-walls 14 and bottom 16 are desirably made of 12-gauge steel and welded so that container 12 is leak-proof. Cover 24 is made of $\frac{3}{8}$ inch steel and is free to be lifted completely off the container.

A circular steel ring 28 is welded within opening 18 in the bottom 16 of container 12, so that it extends above the inner surface of bottom 16 and forms an upwardly projecting circular flange The lower end of an elongated flexible boot 30 fits snugly around the outer side of flange 28 and is firmly compressed into sealing engagement therewith by a stainless-steel hose clamp 32. Flexible boot 30 is desirably accordion-shaped so that it can be stretched lengthwise as well as tilted laterally, and is also securely compressed at its upper end into sealing engagement with the fill-pipe 20 by means of a second stainless-steel hose clamp 34.

In order to allow movement upward and laterally between the container 12 and fill-pipe 20, substantial clearance is provided between the fill-pipe 20 and the inner surface of the ring or flange 28. Such movement has been found to be unavoidable due to frost in colder climates and to settlement of the soil or gravel around the container and even the storage tank. Accordingly, with a conventional four-inch (ID) fill-pipe it is desirable to provide at least three-quarters ($\frac{3}{4}$) of an inch clearance around the fill-pipe 20, thereby allowing adequate movement of the container both vertically and horizontally relative to the fill-pipe, as well as to permit tilting of the fill-pipe within the flange-forming ring 28. Since the flexible boot 30 can therefore be extended or shifted laterally without disturbing the seals at the clamps 32 and 34, no leakage can occur in spite of such undesired movement. Furthermore, the provision of hose-clamps at both ends of boot 30 ensures a permanent seal at each point while making both installation and replacement of the boot as quick and easy as possible.

Figure 3:
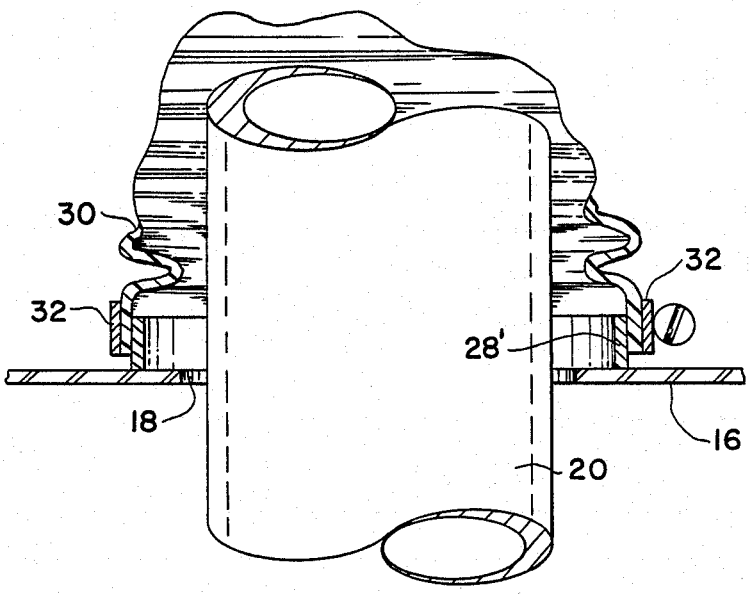
FIG. 3 illustrates an alternative embodiment of the seal between the bottom of the container and the fill-pipe.

FIG. 3 illustrates an alternative way of mounting the circular flange to which the lower end of flexible boot 30 is clamped and sealed to the bottom of container 12. Thus, instead of welding the flange inside the opening 18 in the bottom 16 of container 12, a ring 28' of larger diameter than the corresponding ring 28 of FIG. 1 is positioned concentrically around opening 18 and is welded to the upper surface of bottom 16. The lower end of flexible boot is then either expanded over flange 28' or is made large enough to fit snugly around it. A steel clamp 32 is then moved into place and tightened onto flange 28' as in the preferred arrangement shown in FIG. 1.

Container 12 is provided at its upper end with a rectangular rim (indicated generally at 36) which completely surrounds the periphery thereof for preventing surface water from getting inside. In this instance rim 36 consists of four lengths of angle iron, each having a horizontal leg 38 which is welded along its inner edge to the outer surface of an adjacent side-wall 14 a short distance below the upper edge thereof. A vertical leg 40 of each length of angle iron of rim 36 is integrally formed along the outer edge of horizontal leg 38 with its upper edge projecting above the upper edges of side-walls 14 and level with the upper surface of manhole cover 24. Both ends of each horizontal leg 38 are cut at 45° and welded to adjacent ends of legs 38. Similarly, adjacent ends of vertical legs 40 are welded to form the integral rim 36. Thus, the rim 36 and container side-walls 14 together form a continuous rectangular channel 41 completely around the upper end of container 12 for catching surface water before it enters the container and contaminates any spilled gasoline therein. One or more drain-holes 42 (in this instance two) are formed in horizontal legs 38 for draining water from the channel 41 into rectangularly shaped vertical tubes 44 fixed to the outer sides of side-walls 14 below each hole 42. Tubes 44 are open at the bottom so that water flows into the drainage system below spill-control device 10.

When the spill-control device 10 is installed, the upper edges of the vertical legs 40 of rim 36 are leveled even with the surrounding ground or pavement L, so that snow plows or other equipment do not shift or damage the container 12. Likewise, when the manhole cover 24 is placed over the open end of container 12, it rests on the upper edges of side-walls 14 and fits closely within the upper portions of the four vertical legs 40 of rim 36 which project above the upper edges of side-walls 14 a distance equal to the thickness of the manhole cover 24. Thus, when the cover 24 is in place its upper surface is flush with the upper edges of rim 36, while its underside is spaced above the bottom of channel 41 formed by the horizontal leg-portions 38 of rim 36. Surface water will therefore flow around cover 24 into channel 41 from which it drains through holes 42 and down the sides of container 12 into the ground through vertical tubes 44. It will also be noted that cut-out 26 in the edge of cover 24 for removing same is not as deep horizontally as the width of channel 41, so that any surface water than flows through cut-out 26 is caught in channel 41.

Removably fastened to the bottom of the spill container 12 is a hand-pump 46 having a suction-end 48 which is threaded into a hollow coupling member 50 welded to the bottom 16 of the spill container. Coupling member 50 is provided with at least one lateral opening 52 adjacent the bottom 16 which permits the fluid in the tank to be drawn-up by pump 46 through its suction-end 48. Pump 46 is a suction pump of more or less conventional design, having a plunger rod and handle 54 connected to a piston and cylinder (not shown) inside the body of the pump and a discharge tube 56, through which the fluid is discharged when plunger 54 is drawn upwards. Accordingly, when gasoline is spilled at the fill-pipe 20, it is held in the spill container 12 and is then pumped out by manually reciprocating pump-plunger 54. By inserting the end of discharge tube 56 of pump 46 into the open end of the fill-pipe 20, the spilled gasoline is pumped into the storage tank. On the other hand, if the spillage has been contaminated for any reason, it can be pumped into an external container (not shown).

All the parts of pump 46 are made of corrosion-resistant materials which are not deteriorated by gasoline or water. The pump can be stored on coupling member 50 inside container 12, or it can be readily removed by unthreading its suction-end 48 from coupling member 50 so that it can be kept at some other convenient location. Furthermore, this arrangement makes it easy to remove pump 46 for repair or replacement if necessary.

From the foregoing it will be apparent that the spill-containment device of the present invention is inexpensive to manufacture, easy to install and maintain in existing underground storage tanks primarily, but can be as readily used in new installations as well.

What is claimed is:

1. In a spill-containment device for holding a fluid spilled while filling an underground storage tank having a fill-pipe extending upward substantially to ground level, the combination comprising a container having a side-wall and a bottom having an opening therein for receiving the upper end of said fill-pipe, said side-wall having an upper edge and the upper end of said container being open for access to said fill-pipe, said container being adapted for underground installation with said upper edge of said side-wall disposed below the surface surrounding said container, a removable cover for closing said open end supported on said upper edge of said side-wall with its upper surface substantially level with said surrounding surface, means for sealing said fill-pipe within said opening in said bottom, a channel-forming rim fixed to the outer surface of said side-wall and surrounding the upper edge thereof for preventing surface water and debris from entering said container, said channel-forming rim comprising a first leg-portion which is substantially continuous and disposed substantially horizontally, said first leg-portion having inner and outer edges, said inner edge being fixed to said side-wall below said upper edge thereof and substantially continuous therewith, and a second leg-portion extending upwardly form said outer edge of said first leg-portion to said surrounding surface, and means for draining said surface water and debris from said channel.

2. A spill-containment device as defined in claim 1, wherein said channel-forming rim is fabricated out of standard angle iron, the legs of which form said first and second leg-portions.

3. A spill-containment device as defined in claim 2, wherein said container is rectangular and consists of four of said side-walls, said channel-forming rim comprising four sections of said angle iron with said inner edge of each of said horizontal leg-portions welded to the outer surface of one of said side-walls, the ends of said first leg-portion of each of said sections being mitered and both said leg-portions of each section being welded at their ends to adjacent ones of said sections.

4. A spill-containment device as defined in claim 1, wherein said means for draining surface water from said channel comprises at least one hole in said first leg-portion.

5. A spill-containment device as defined in claim 4, wherein said means for draining water from said channel further comprises a tube disposed below said hole and extending downward to the bottom of said container, said tube being fixed to the outside of said side-wall of said container.

* * * * *